United States Patent [19]

Gunji et al.

[11] 4,289,533

[45] Sep. 15, 1981

[54] DEOXIDIZING ALLOY FOR MOLTEN STEEL

[75] Inventors: Koki Gunji, Tokyo; Takehiro Dan, Funabashi, both of Japan

[73] Assignee: National Research Institute for Metals, Tokyo, Japan

[21] Appl. No.: 108,060

[22] Filed: Dec. 28, 1979

Related U.S. Application Data

[63] Continuation of Ser. No. 937,122, Aug. 28, 1978, abandoned.

[30] Foreign Application Priority Data

Mar. 2, 1978 [JP] Japan ..... 53/22851

[51] Int. Cl.[3] ..... C22C 21/00

[52] U.S. Cl. ..... 75/138

[58] Field of Search ..... 75/138, 57, 58

[56] References Cited

U.S. PATENT DOCUMENTS

| | | | |
|---|---|---|---|
| 2,980,529 | 4/1961 | Knapp | 75/57 |
| 3,729,309 | 4/1973 | Kawawa | 75/53 |
| 3,844,777 | 10/1974 | Werner | 75/138 |

*Primary Examiner*—P. D. Rosenberg

*Attorney, Agent, or Firm*—Sherman & Shalloway

[57] ABSTRACT

A deoxidizing agent for molten steel, which is an alloy of aluminum and at least 2 mole %, based on the aluminum, of an element of Group IIIa of the periodic table. In steel which has been deoxidized with this deoxidizer, an oxide inclusion based on the deoxidizer is not dendritic but spherical, and does not cause defects to steel products. Misch metal is especially preferred as the Group IIIa metal.

1 Claim, 15 Drawing Figures

Figure 2A:
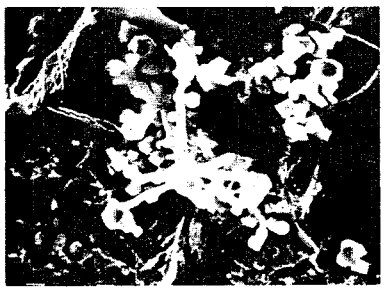

Fig. 1-(A)
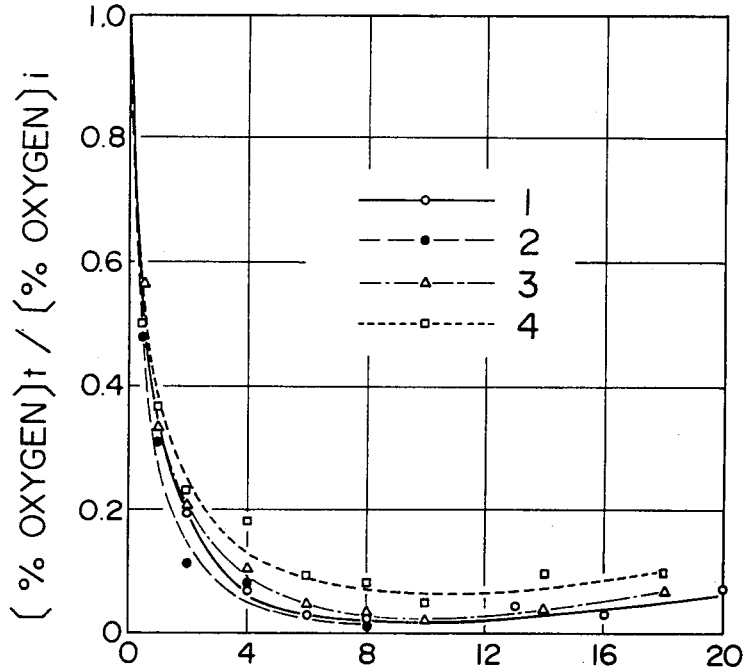
Fig. 1-(B)
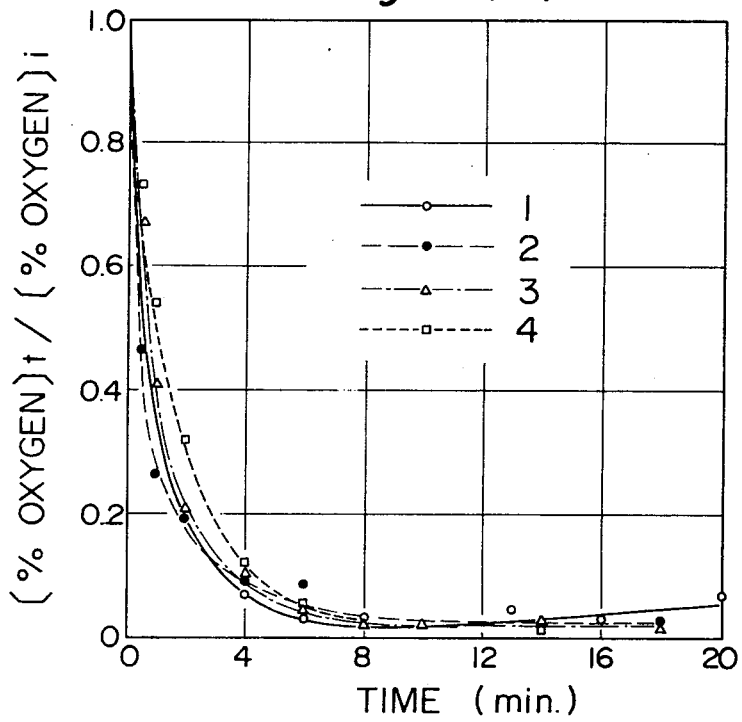

Fig. 1-(C)
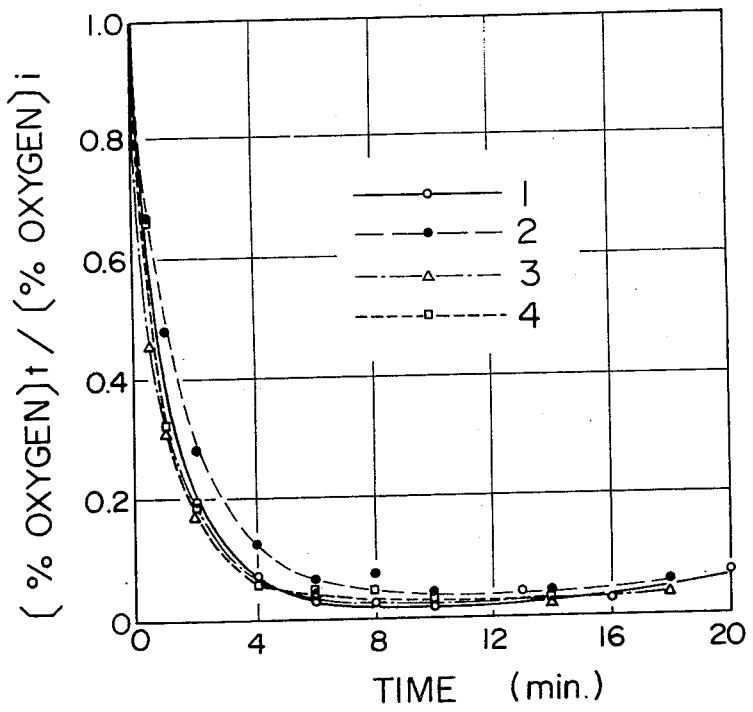

10 μ

10 μ

10 μ

10 μ

10 μ

20 μ

10 μ

10 μ

10 μ

DEOXIDIZING ALLOY FOR MOLTEN STEEL

This is a continuation of application Ser. No. 937,122, filed Aug. 28, 1978, now abandoned.

This invention relates to a deoxidizing alloy for deoxidizing molten steel in a melting furnace, ladle or casting mold.

Generally, killed steel is produced by first deoxidizing molten steel with a metal having a great deoxidizing ability such as aluminum, and then subjecting the deoxidized molten steel to an ingot-making method or a continuous casting method. However, the conventional method of deoxidation using aluminum as a deoxidizer forms dendritic alumina which in turn will cause various defects. For example, the dendritic alumina adheres in the sintered state to the nozzle of a turndish used in the continuous casting process and clogs the nozzle. Or the dendritic alumina accumulates in a sedimental zone formed at the bottom of a large-sized steel ingot to form a huge cluster which will cause ultrasonic probe defects or laminations to the steel. It also causes the generation of surface defects on a thin steel sheet produced by rolling a steel ingot deoxidized with aluminum. These defects are ascribable to dendritic alumina which is formed at the time of deoxidizing molten steel and remains in the steel without being fully separated from it.

Accordingly, it is an object of this invention to provide a deoxidizer capable of deoxidizing molten steel to a low oxygen concentration at a very rapid speed without forming dendritic oxide inclusions.

Another object of this invention is to provide a deoxidizer for producing a killed steel ingot in which the remaining oxide inclusion will not adversely affect the final steel product.

The above objects of the invention are achieved by a deoxidizing alloy for molten steel comprising aluminum and at least 2 mole%, based on the aluminum, of at least one element of Group IIIa of the periodic table.

The deoxidizing agent of the invention should be an alloy of aluminum and at least one element of Group IIIa. If aluminum and an element of Group IIIa are added to molten steel without making them into an alloy, dendritic $Al_2O_3$ and a dendritic oxide of the element of Group IIIa are formed respectively, and the objects of the invention cannot be achieved. In contrast, when aluminum and at least 2 mole% of an element of Group IIIa are added as an alloy to molten steel, spherical complex oxides of aluminum and the element of Group IIIa is formed, thus making it possible to prevent the formation of a dendritic oxide.

The elements of Group IIIa which form alloys with aluminum in the present invention are scandium, yttrium, and rare earth elements. These metals can be used either alone or as a mixture of two or more. In particular, misch metal (containing about 40 to 50% of Ce, about 20 to 40% of La and other rare earth metals) well known as a mixture of cerium earths is suitable for use in this invention because of its easy availability and relatively low cost.

When an alloy of aluminum and less than 2 mole%, based on the aluminum, of an element of Group IIIa, for example a binary alloy of aluminum and yttrium or cerium, is used to deoxidize molten steel, dendritic alumina containing a small amount of an oxide of the Group IIIa element, such as $Y_2O_3$ or $Ce_2O_3$, is formed, and remains as an inclusion in the steel. In contrast, when molten steel is deoxidized with a binary alloy of aluminum and about 2 mole% of the Group IIIa element, there is substantially no formation of a dendritic inclusion, but a spherical inclusion results. The rate of deoxidation of the deoxidizer or the invention does not appreciably change when the content of the Group IIIa metal varies within a relatively lower range of the specified content. However, when the content of the Group IIIa metal becomes too large, for example, when it exceeds 10 mole% based on aluminum, the amount of the Group IIIa metal oxide in the inclusion increases, and the speed of deoxidation decreases.

Preferably, therefore, the amount of the Group IIIa metal to be included in the deoxidizing alloy of the invention should be 10 mole% or less.

The deoxidizing alloy of the invention can be easily prepared by adding a predetermined proportion of an element of Group III of the periodic table to molten aluminum.

The deoxidizing alloy of the invention can be added either as a lump or as a wire to molten steel in a melting furnace, ladle or mold.

By adding the deoxidizing alloy of the invention according to the oxygen content of molten metal, the deoxidation reaction proceeds at a high speed, and the molten steel is deoxidized to a low oxygen concentration. The amount of the deoxidizing alloy of the invention is usually 1 to 2 times the stoichiometrical amount based on the amount of oxygen in the steel.

Since the deoxidation product remaining as inclusions in the resulting deoxidized steel is not dendritic, it does not tend to deposit on the sedimental zone of the steel ingot, and does not form a huge cluster. Furthermore, a steel sheet produced by rolling the steel ingot deoxidized with the deoxidizing alloy of the invention does not develop surface defects ascribable to dendritic alumina.

Figure 2B:
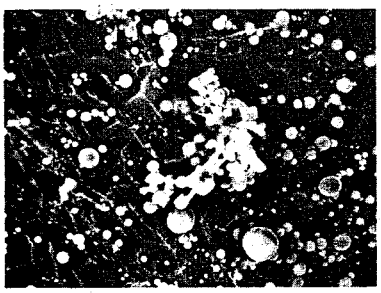
Figure 2C:
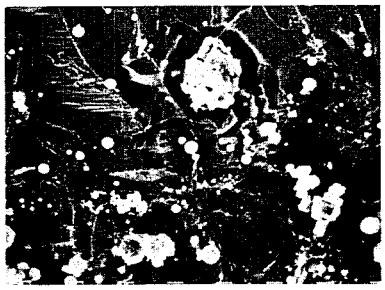
Figure 2D:
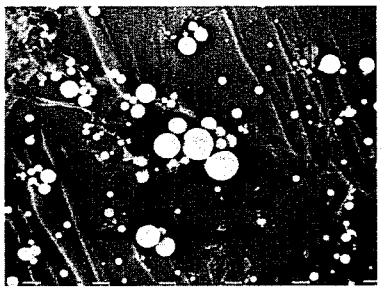
Figure 2E:
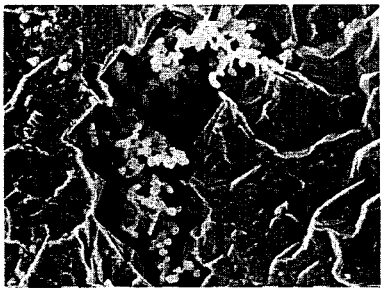
Figure 3A:
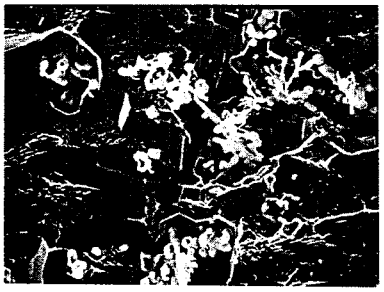
Figure 3B:
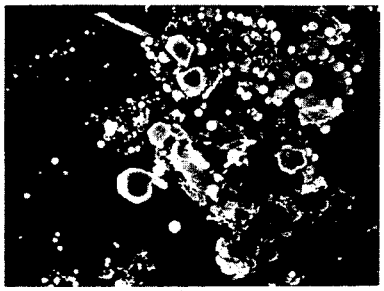
Figure 3C:
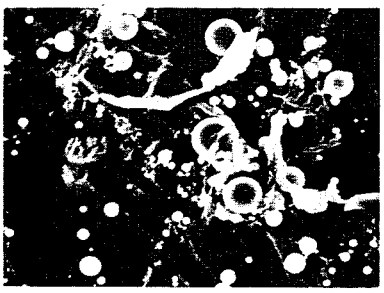
Figure 4A:
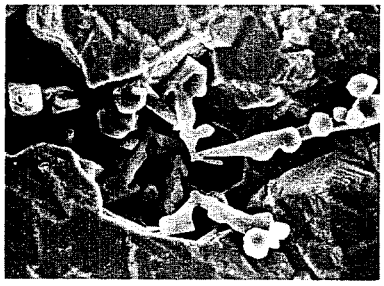
Figure 4B:
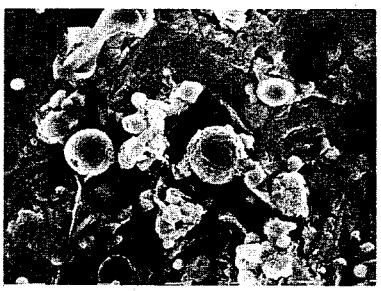
Figure 4C:
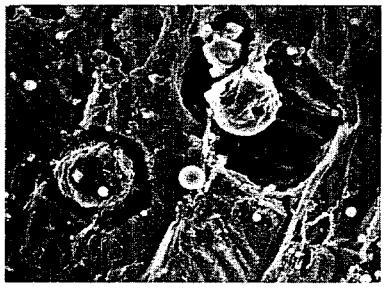
Figure 4D:
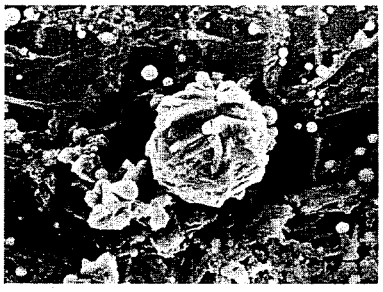

In the accompanying drawings,

FIGS. 1(A)–(B) is a graph showing variations in the concentration of oxygen in molten steel at the time of deoxidizing it with the deoxidizing alloy of the invention; and FIGS. 2*a–e*, 3*a–c* and 4*a–d* are photographs showing the scanning electron images of inclusions remaining in molten steel at the time of deoxidizing it by addition of the deoxidizing alloy of the invention.

For comparison, FIGS. 2*a–e*, 3*a–c* and 4*a–d* also show the case of deoxidizing molten steel with aluminum alone.

The following Examples illustrate the present invention more specifically.

EXAMPLE 1

One kilogram of molten steel at 1600° C. containing 0.06 to 0.08% of oxygen was deoxidized with each of three kinds of Al-Ce alloys containing 2.5, 5 and 10 mole% of Ce. The amount of the alloy corresponded to 0.15% based on aluminum. The variations of the oxygen concentration of the molten steel with time were examined.

For comparison, Al and an Al-Ce alloy with a Ce content of 1 mole% were tested as a deoxidizer under the same conditions as described above. The results are shown in Table 1.

The data given in Table 1 are plotted in a graph in which the axis of abscissas represents the time that elapsed after the addition of the deoxidizer and the axis of ordinates, the oxygen concentration of molten steel [(FIG. 1(A)]. The result obtained with the use of an Al-Ce alloy with a Ce content of 2.5 mole% is not shown.

In FIG. 1 (A), curves 1, 2, 3 and 4 respectively show the oxygen concentrations attained when adding Al, Al-Ce (1 mole%), Al-Ce (5 mole%) and Al-Ce (10 mole%) as a deoxidizer.

The scanning electron images of the inclusions which remained in molten steel 30 seconds after the addition of the deoxidizers are shown in FIG. 2. In FIG. 2, (*a*), (*b*), (*c*), and (*d*) respectively show the inclusions which formed when deoxidizing molten steel with Al-C (1 mole%), Al-Ce (2.5 mole%), Al-Ce (5 mole%), and Al-Ce (10 mole%)

TABLE 1

| Deoxider | Time after addition min | Initial | 0.5 | 1 | 2 | 4 | 6 | 8 | 10 | 13 | 14 | 16 | 18 | 20 |
|---|---|---|---|---|---|---|---|---|---|---|---|---|---|---|
| | (% 0) | 0.0562 | — | — | 0.0110 | 0.0039 | 0.0015 | 0.0014 | 0.0011 | 0.0023 | — | 0.0015 | — | 0.0040 |
| Al | | | | | | | | | | | | | | |
| | Ratio | | — | — | 0.196 | 0.069 | 0.027 | 0.025 | 0.019 | 0.041 | — | 0.027 | — | 0.071 |
| Al-Ce | (% 0) | 0.0594 | 0.0283 | 0.0184 | 0.0066 | 0.0049 | 0.0018 | 0.006 | 0.0025 | — | 0.0070 | — | — | — |
| (1 mol %) | Ratio | | 0.478 | 0.310 | 0.111 | 0.082 | 0.031 | 0.011 | 0.042 | — | 0.117 | — | — | — |
| Al-Ce | (% 0) | 0.0821 | 0.0436 | 0.0385 | 0.0173 | 0.0059 | 0.0040 | 0.0038 | 0.0035 | — | 0.0032 | — | 0.0051 | — |
| (2.5 mol %) | Ratio | | 0.531 | 0.469 | 0.210 | 0.072 | 0.048 | 0.046 | 0.042 | — | 0.039 | — | 0.063 | — |
| Al-Ce | (% 0) | 0.0548 | 0.0311 | 0.0183 | 0.0114 | 0.0034 | 0.0028 | 0.0017 | 0.0013 | — | 0.0023 | — | 0.0039 | — |
| (5 mol %) | Ratio | | 0.568 | 0.334 | 0.208 | 0.103 | 0.050 | 0.032 | 0.024 | — | 0.041 | — | 0.070 | — |
| Al-Ce | (% 0) | 0.0771 | 0.0386 | 0.0283 | 0.0179 | 0.0138 | 0.0073 | 0.0060 | 0.0038 | — | 0.0074 | — | 0.0069 | — |
| (10 mol %) | Ratio | | 0.500 | 0.367 | 0.233 | 0.179 | 0.095 | 0.078 | 0.049 | — | 0.096 | — | 0.089 | — |

Note:

$$\text{Ratio} = \frac{(\%\ O)t}{(\%\ O)i}$$

(% O)i : initial oxygen content (% O)t : oxygen content at time, t.

It can be seen from Table 1, FIG. 1(A) and FIG. 2 that when the Ce content of the aluminum-cerium alloy increases, the rate of deoxidization somewhat decreases, and that the oxide inclusion was dendritic when Al and Al-Ce (1 mole%) were used, whereas with Al-Ce (2.5 mole%), almost all of the inclusion is spherical, and with Al-Ce (10 mole%), the inclusion is completely spherical.

The inclusion which formed when Al-Ce (10 mole%) was used as a deoxidizer was analyzed by an X-ray microanalyzer. As a result, the inclusion was found to be a complex oxide of $Al_2O_3$ and $Ce_2O_3$ with a $Ce_2O_3$ content of 15 to 72%.

EXAMPLE 2

The same test as in Example 1 was conducted using an Al-Y alloy and an aluminum-misch metal alloy (Al-MM for short) instead of the Al-Ce alloys. The results are shown in Tables 2 (Al-Y alloy) and 3 (Al-MM alloy).

These data are plotted in FIG. 1(B) (Al-Y alloy) and FIG. 1(C) (Al-MM alloy) in the same way as in Example 1. In FIG. 1(B), curves 1, 2, 3 and 4 respectively show variations in the oxygen concentration of molten steel when adding Al, Al-Y (1 mole%), Al-Y (5 mole%), and Al-Y (10 mole%). In FIG. 1(C), curves 1, 2, 3 and 4 respectively show variations in the oxygen concentration of molten steel when adding Al, Al-MM (1 mole%), Al-MM (5 mole%), and Al-MM (10 mole%).

The scanning electron images of the inclusions formed 30 seconds after the addition of the deoxidizers are shown in FIG. 3,(*a*) [Al-Y(1 mole%)], (*b*) [Al-Y (5 mole%)], (*c*) [Al-Y (10 mole%)], and in FIG. 4, (*a*) [Al-MM (1 mole%)], (*b*) [Al-MM (2.5 mole%)], (*c*) [Al-MM (5 mole%)], and (*d*) [Al-MM (10 mole%)].

TABLE 2

| Deoxidizer | | Time after addition min | | | | | | | | | | | | |
|---|---|---|---|---|---|---|---|---|---|---|---|---|---|---|
| | | Initial | 0.5 | 1 | 2 | 4 | 6 | 8 | 10 | 13 | 14 | 16 | 18 | 20 |
| Al | (% 0) | 0.0562 | — | — | 0.0110 | 0.0039 | 0.0015 | 0.0014 | 0.0011 | 0.0023 | — | 0.0015 | — | 0.0040 |
| | Ratio | | — | — | 0.196 | 0.069 | 0.027 | 0.025 | 0.019 | 0.041 | — | 0.027 | — | 0.071 |
| Al-Y | (% 0) | 0.0721 | 0.0334 | 0.0188 | 0.0132 | 0.0071 | 0.0063 | 0.0025 | 0.0018 | — | 0.0018 | — | 0.0019 | — |
| (1 mol%) | Ratio | | 0.462 | 0.261 | 0.184 | 0.098 | 0.088 | 0.034 | 0.025 | — | 0.025 | — | 0.026 | — |
| Al-Y | (% 0) | 0.0728 | 0.0480 | 0.0297 | 0.0153 | 0.0076 | 0.0030 | 0.0018 | 0.0017 | — | 0.0024 | — | 0.0012 | — |
| (5 mol%) | Ratio | | 0.667 | 0.408 | 0.209 | 0.104 | 0.041 | 0.025 | 0.023 | — | 0.033 | — | 0.017 | — |
| Al-Y | (% 0) | 0.0714 | 0.0521 | 0.0385 | 0.0227 | 0.0087 | 0.0039 | 0.0026 | 0.0016 | — | 0.0011 | — | 0.0018 | — |
| (10 mol%) | Ratio | | 0.730 | 0.538 | 0.318 | 0.122 | 0.055 | 0.036 | 0.022 | — | 0.016 | — | 0.025 | — |

TABLE 3

| Deoxidizer | | Time after addition min | | | | | | | | | | | | |
|---|---|---|---|---|---|---|---|---|---|---|---|---|---|---|
| | | Initial | 0.5 | 1 | 2 | 4 | 6 | 8 | 10 | 13 | 14 | 16 | 18 | 20 |
| Al | (%0) | 0.0562 | — | — | 0.0110 | 0.0039 | 0.0015 | 0.0014 | 0.0011 | 0.0023 | — | 0.0015 | — | 0.0040 |
| | Ratio | | — | — | 0.196 | 0.069 | 0.027 | 0.025 | 0.019 | 0.041 | — | 0.027 | — | 0.071 |
| Al-MM | (%0) | 0.0671 | 0.0446 | 0.0323 | 0.0187 | 0.0085 | 0.0042 | 0.0049 | 0.0025 | — | 0.0026 | — | 0.0036 | — |
| (1 mol %) | Ratio | | 0.664 | 0.481 | 0.279 | 0.126 | 0.062 | 0.073 | 0.038 | — | 0.039 | — | 0.055 | — |
| Al-MM | (%0) | 0.709 | 0.398 | 0.212 | 0.0113 | 0.0059 | 0.0043 | 0.0014 | 0.0027 | — | 0.0021 | — | 0.0030 | — |
| (2.5 mol%) | Ratio | | 0.561 | 0.298 | 0.160 | 0.083 | 0.061 | 0.020 | 0.038 | — | 0.030 | — | 0.043 | — |
| Al-MM | (%0) | 0.0665 | 0.306 | 0.0205 | 0.0115 | 0.0042 | 0.0030 | 0.0016 | 0.0018 | — | 0.0019 | — | 0.0027 | — |
| (5 mol%) | Ratio | | 0.460 | 0.309 | 0.173 | 0.064 | 0.045 | 0.024 | 0.027 | — | 0.028 | — | 0.040 | — |
| Al-MM | (%0) | 0.715 | 0.0472 | 0.0229 | 0.0132 | 0.0038 | 0.0029 | 0.0029 | 0.0028 | — | 0.0020 | — | — | — |

TABLE 3-continued

| Deoxidizer | | Time after addition min | | | | | | | | | | | | |
|---|---|---|---|---|---|---|---|---|---|---|---|---|---|---|
| | | Initial | 0.5 | 1 | 2 | 4 | 6 | 8 | 10 | 13 | 14 | 16 | 18 | 20 |
| (10 mol%) | Ratio | | 0.659 | 0.320 | 0.185 | 0.053 | 0.041 | 0.041 | 0.039 | — | 0.028 | — | — | — |

Note:
1. MM: misch metal
2. The atomic weight of MM was an average atomic weight.

It is seen from Tables 2 and 3, FIGS. 1(B), 3 and 4 that with an increase in the amount of Y or MM in the deoxidizing agent, the same tendency as in Example 1 is observed.

The inclusion which formed when using the Al-Y (10 mole%) alloy was analyzed by an X-ray microanalyzer. As a result, the inclusion was found to be a complex oxide of $Al_2O_3$ and $Y_2O_3$ with a $Y_2O_3$ content of 0.3 to 47.4%.

What we claim is:

1. A deoxidizing alloy for molten steel consisting essentially of aluminum and from 2 to 10 mole %, based on the aluminum, of yttrium.

* * * * *